US005792009A

United States Patent [19]

Maruko

[11] Patent Number: 5,792,009

[45] Date of Patent: Aug. 11, 1998

[54] GOLF BALL

[75] Inventor: Takashi Maruko, Chichibu, Japan

[73] Assignee: Bridgestone Sports Co., Ltd., Tokyo, Japan

[21] Appl. No.: 797,944

[22] Filed: Feb. 12, 1997

[30] Foreign Application Priority Data

Feb. 16, 1996 [JP] Japan ..... 8-053917

[51] Int. Cl.[6] ..... A63B 37/06; A63B 37/12

[52] U.S. Cl. ..... 473/359; 473/357; 473/373; 473/377

[58] Field of Search ..... 473/357, 377, 473/373, 374, 359, 372; 273/DIG. 20, 230

[56] References Cited

U.S. PATENT DOCUMENTS 4,006,900 2/1977 Di Vito ..... 473/457
4,643,424 2/1987 Nakajima ..... 473/377 X
4,863,167 9/1989 Matsuki et al. ..... 273/DIG. 20
5,132,622 7/1992 Valentino ..... 473/353 X
5,387,637 2/1995 Sullivan ..... 473/359 X
5,439,227 8/1995 Egashira et al. ..... 473/377 X

*Primary Examiner*—George J. Marlo
*Attorney, Agent, or Firm*—Sughrue, Mion, Zinn, Macpeak & Seas, PLLC

[57] ABSTRACT

In a golf ball comprising a solid or wound core and a cover, the solid core or a center of the wound core is prepared by molding and vulcanizing a rubber composition comprising 100 parts by weight of base rubber and 10–120 parts by weight of a weight adjuster having a mean particle size of 30–1,000 μm and a specific gravity of 4–19.1. The solid core or center is improved in restitution and the ball will fly a longer distance.

20 Claims, 2 Drawing Sheets

GOLF BALL

BACKGROUND OF THE INVENTION

1. Field of the Invention

This invention generally relates to a golf ball and more particularly, to a solid or wound golf ball wherein the solid core or a center of the wound core is prepared from a rubber composition having blended therein an inexpensive weight adjuster having a relatively large mean particle size whereby the solid core or center is improved in restitution.

2. Prior Art

Conventional solid cores and centers of wound cores are formed of rubber compositions comprising base rubber, a crosslinking agent, a co-crosslinking agent, and a weight adjuster. The co-crosslinking agent causes co-crosslinking or vulcanization to occur between base rubber and the crosslinking agent to produce solid cores or centers. The weight adjuster is blended for the purpose of adjusting the weight of the golf ball. Heretofore, inexpensive weight adjusters having a relatively high specific gravity, for example, zinc white (ZnO) and barium sulfate ($BaSO_4$) are commonly used.

In order to increase the flight distance of a golf ball, the ball must be improved in restitution since the initial velocity that the ball gains immediately after launching makes a great contribution to the flight distance. It was thus proposed in Japanese Patent Publication (JP-B) No. 51930/1990 to increase the initial velocity of a ball by using tungsten carbide having a high specific gravity (~15.8) as a weight adjuster to increase the volume fraction of rubber, thereby improving the restitution of the ball. This proposal of improving restitution by increasing the volume fraction of rubber is impractical because tungsten carbide is very expensive as a rubber additive.

SUMMARY OF THE INVENTION

An object of the present invention is to provide a cost effective golf ball wherein an optimum weight adjuster is blended in a rubber composition of which a solid core or a center of a wound core is formed whereby the solid core or the wound core center is improved in restitution, thereby increasing the initial velocity and hence, the flight distance of the ball.

One conventional means for improving the restitution of a golf ball is to use a high specific gravity weight adjuster to increase the volume fraction of rubber as previously mentioned. The inventors paid attention to the contact area (mean particle size) of a weight adjuster as another means for improving the restitution of a golf ball. Provided that rubber compositions had a specific gravity of 1.35, the inventors prepared simple blend system models consisting of rubber and a weight adjuster having a mean particle size of 1 μm, 10 μm and 100 μm and investigated the relationship of the specific gravity of the weight adjuster and the contact area of the weight adjuster per unit volume. The results are plotted in the graph of FIG. 1 wherein the contact area ($CM^2$) and the specific gravity ($g/cm^3$) of a filler are on the ordinate and abscissa, respectively. It is seen from FIG. 1 that (1) the contact area of a weight adjuster can be more effectively reduced by increasing its mean particle size than by increasing its specific gravity, (2) the contact area and the specific gravity of a weight adjuster are in inverse proportional relationship, and (3) the effect of reducing the contact area of a weight adjuster by increasing its specific gravity is little when the specific gravity exceeds 7.

Based on these findings (1) to (3), the inventors have found that by blending a proper amount of a weight adjuster having a mean particle size of 30 to 1,000 μm and a specific gravity of at least 4 in a rubber composition, a further effect of reducing the contact area is derived from the weight adjuster having such a large mean particle size whereby the solid core or center is increased in restitution. Then the ball will gain an increased initial velocity and travel a longer distance. The weight adjuster meeting the above requirements can be chosen from inexpensive materials such as zirconium silicate, barium sulfate, chromite, and iron oxide offering an economical advantage.

According to the invention, there is provided a golf ball comprising a solid core or wound core and a cover. The solid core or a center of the wound core is prepared by molding and vulcanizing a rubber composition comprising 100 parts by weight of base rubber and at least 10 parts by weight of a particulate weight adjuster having a mean particle size of 30 to 1,000 μm and a specific gravity of at least 4.

DESCRIPTION OF THE PREFERRED EMBODIMENTS

Figure 1:
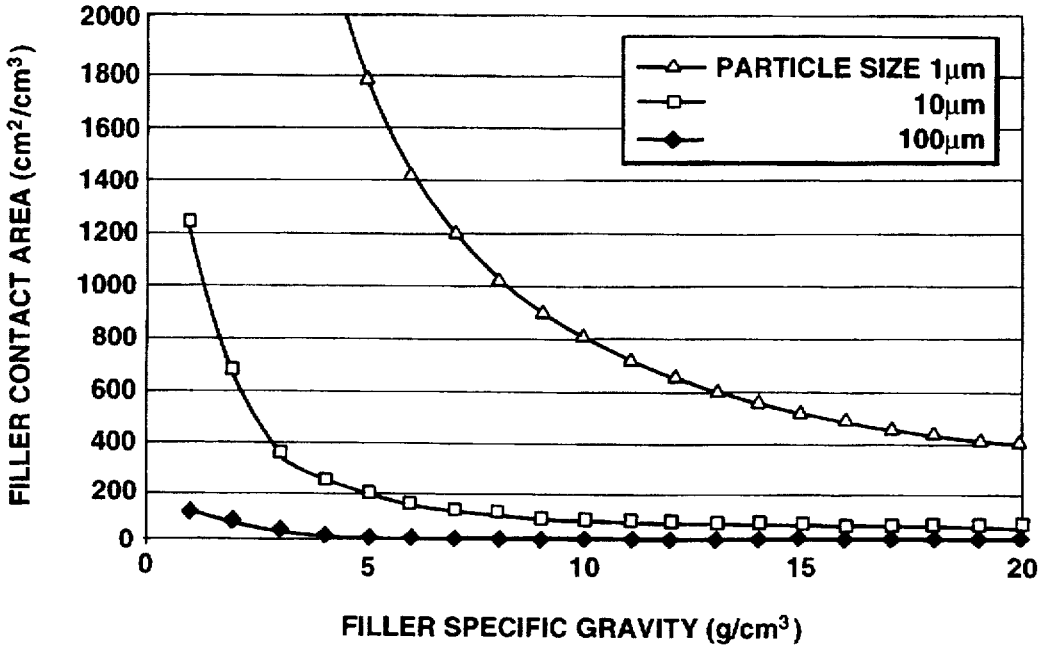
FIG. 1 is a graph showing the contact area per unit volume vs. the specific gravity of fillers having a mean particle size of 1, 10 and 100 μm.
Figure 2:
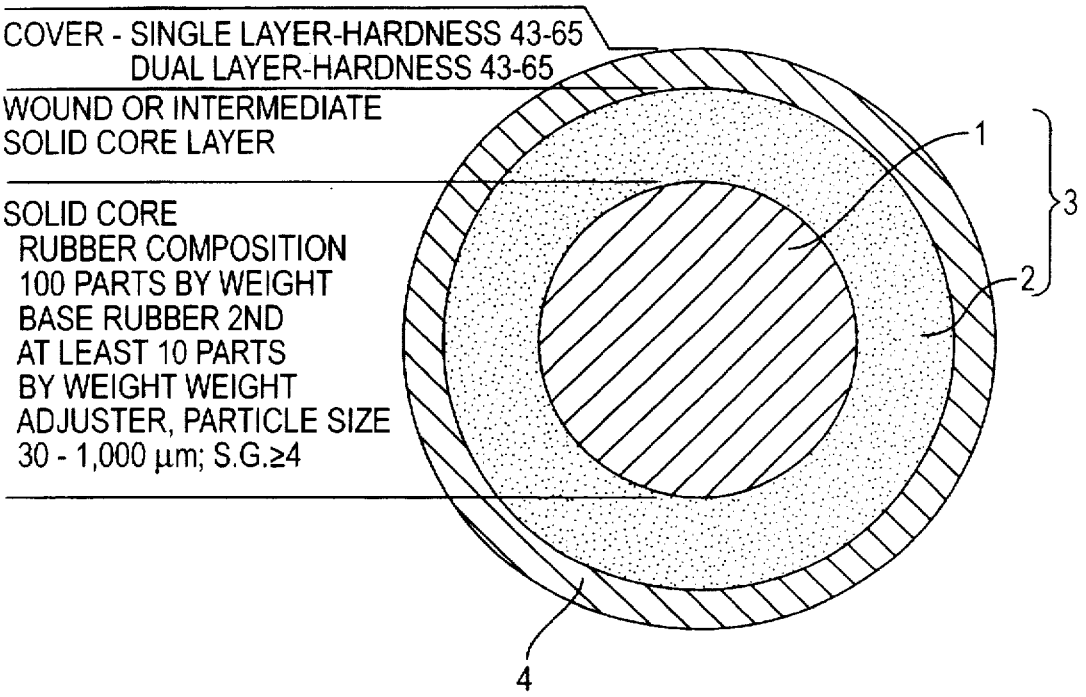
FIG. 2 is a cross-section of a golf ball in accordance with this invention.

The invention is applicable to either wound golf balls comprising a wound core (consisting of a solid center 1 and thread rubber 2 wound thereon) and a cover 4 enclosing the core or solid golf balls comprising a solid core and a cover enclosing the core as illustrated in FIG. 2. In the case of solid golf balls, the core 3 may have a multilayer structure including a solid core and an overlying intermediate layer 2 while the cover 4 may consist of a single layer, two layers or multiple layers. Included are two-piece balls having a single layer cover, three-piece balls having a two layer cover, and multi-piece balls having a multiple layer cover.

According to the invention, the solid core 1 of the solid golf ball or the center of the wound core 1 of the wound golf ball is formed of a rubber composition having blended therein an appropriate amount of a weight adjuster having an optimum specific gravity and mean particle size, thereby increasing the restitution of the solid core or the wound core center, promising an increased flight distance.

The weight adjuster should have a mean particle size of 30 to 1,000 μm and a specific gravity of at least 4. Insofar as these requirements are met, a choice may be made among various weight adjusters. From the economical aspect, a choice is preferably made among zirconium silicate, barium sulfate, chromite, and iron oxide and mixtures of two or more.

More specifically, the weight adjuster has a mean particle size of 30 to 1,000 μm, preferably 100 to 200 μm. A mean particle size of less than 30 μm would be ineffective for reducing the contact area, failing to improve ball restitution. A mean particle size of more than 1,000 μm could adversely affect kneading efficiency and durability. The weight adjuster should preferably have such a hardness that it may not be fractured during kneading and the large mean particle size be maintained in the rubber composition. From this point of view, the weight adjuster preferably has a hardness of at least 3.5, especially at least 5 on Mohs scale. It is noted that the "Mohs scale" is an index for comparing the hardness of minerals by rubbing two minerals with each other, with a scratched one being regarded softer. For measurement, a Mohs scale of hardness meter is used.

The weight adjuster has a specific gravity of at least 4 because a specific gravity of less than 4 leads to a reduced fraction of rubber, resulting in a ball being reduced in restitution. The upper limit of specific gravity is not critical although the specific gravity is generally up to 19.1.

The weight adjuster is blended in an amount of at least 10 parts by weight, preferably 15 to 120 parts by weight per 100 parts by weight of base rubber. The more preferred amount of weight adjuster is 10 to 25 parts by weight in the case of solid golf balls and 25 to 100 parts by weight in the case of wound golf balls. Less than 10 parts of the weight adjuster per 100 parts of base rubber is ineffective for reducing the contact area, failing to improve the restitution of the ball.

In addition to the weight adjuster, the rubber composition contains a baser rubber, a crosslinking agent, a co-crosslinking agent, an inert filler, and the like. The base rubber may be selected from natural rubber and synthetic rubbers used in conventional golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide. About 5 to 40 parts by weight of the crosslinking agent is preferably blended with 100 parts by weight of the base rubber.

The co-crosslinking agent is typically selected from metal salts of unsaturated fatty acids, inter alia, zinc and magnesium salts of unsaturated fatty acids having 3 to 6 carbon atoms (e.g., acrylic acid and methacrylic acid) though not limited thereto. Zinc acrylate is especially preferred. Examples of the inert filler include zinc oxide, silica, calcium carbonate, and zinc carbonate, with zinc oxide being often used. The amount of the filler blended is preferably about 15 to 80 parts by weight per 100 parts by weight of the base rubber although the amount largely varies with the specific gravity of the core and cover and other factors. In this case, at least 5 parts by weight of zinc oxide is preferably blended as the co-crosslinking agent.

Rubber compositions comprising the above-mentioned components preferably have a specific gravity of at least 1.15, especially 1.16 to 1.8. A specific gravity of less than 1.15 means that a less amount of the weight adjuster is blended, failing to achieve the objects of the invention.

A rubber composition is prepared by kneading the above-mentioned components in a conventional mixer such as a kneader and roll mill, and it is compression or injection molded in an appropriate mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a solid core or center. No particular limits are imposed on the diameter, weight and hardness of the solid core 1 or center and these parameters may be properly selected insofar as the objects of the invention are achievable. Usually, solid cores of two- and three-piece solid golf balls have a diameter of 34 to 41 mm, a weight of 24 to 35 grams, a hardness corresponding to a distortion of 2.5 to 4.5 mm under a load of 100 kg, and a hardness of 50 to 80 at the core center as measured by a JIS C scale hardness meter. Solid centers of wound golf balls have a diameter of 26 to 35 mm, a weight of 15 to 28 grams, a hardness corresponding to a distortion of 1.6 to 5.0 mm under a load of 30 kg, and a hardness of 30 to 70 at the center ball center as measured by a JIS C scale hardness meter.

In the case of wound golf balls, thread rubber 2 is wound on the center 1 by a conventional method to form a wound core. No particular limits are imposed on the diameter, weight and hardness of the wound core and these parameters may be properly selected insofar as the objects of the invention are achievable. In general, wound cores have a diameter of 38 to 41 mm, a weight of 35 to 38 grams, and a hardness corresponding to a distortion of 2.5 to 3.6 mm under a load of 100 kg.

Any of well-known cover stocks may be used to form a cover 4 on the solid core or wound core. For example, a choice may be made among ionomer resins, balata rubber, and urethane resins. An ionomer resin base stock is preferred while a mixture of two or more ionomer resins may be used.

The cover is often a single layer structure although a multiple layer structure is acceptable. In the case of a single layer structure, the cover preferably has a Shore D hardness of 43 to 65 and a gage of 1 to 2.5 mm. In the case of a two layer structure, the cover inner layer preferably has a Shore D hardness of 60 to 65 and a gage of 0.5 to 2 mm and the cover outer layer preferably has a Shore D hardness of 43 to 53 and a gage of 0.5 to 2 mm.

The cover stock may be adjusted in specific gravity and hardness by optionally adding titanium dioxide, barium sulfate, magnesium stearate, etc. thereto. Furthermore, UV absorbers, antioxidants, and dispersing aids (e.g., metal soaps) may be added if desired.

Any desired method may be used to enclose the core with the cover. In general, the core is enclosed with a pair of hemi-spherical preformed shells, followed by heat compression molding. Alternatively, the cover stock is injection molded over the core.

The thus obtained golf ball of the invention is conventionally formed with a multiplicity of dimples in the cover surface. The ball is further subject to finishing steps including buffing, painting and stamping.

While the golf ball of the invention is constructed as mentioned above, the ball as a whole should preferably have a hardness corresponding to a distortion of 2.5 to 3.6 mm, especially 2.7 to 3.4 mm under a load of 100 kg. The diameter, weight and other parameters of the ball may be properly selected in accordance with the Rules of Golf.

There has been described a solid golf ball or wound gold ball wherein an inexpensive weight adjuster having an optimum mean particle size and specific gravity is blended in a rubber composition of which the solid core or the wound core center is formed whereby the solid core or the wound core center is improved in restitution, thereby increasing the initial velocity and hence, the flight distance of the ball. Advantageously the ball is of low cost.

EXAMPLE

Examples of the present invention are given below by way of illustration and not by way of limitation. All parts are by weight.

Examples 1–6 & Comparative Examples 1–2

Thread wound golf balls were prepared. A center was first prepared by kneading a center-forming rubber composition of the formulation shown in Table 1 in a roll mill and vulcanizing the composition in a mold at 155° C. for about 12 minutes.

Thread rubber of the composition shown below was wound on the center to form a wound core. Half cups were formed from a cover stock of the composition shown below. The wound core was enclosed with a pair of half cups, placed in a negative dimple pattern-bearing mold, and compression molded at 140° C. for about 5 minutes.

| | Parts by weight |
|---|---|
| Thread rubber composition | |
| Polyisoprene rubber | 70 |
| Natural rubber | 30 |
| Zinc oxide | 1.5 |
| Magnesium stearate | 1.0 |
| Vulcanization accelerator + sulfur | 2.6 |
| Ionomer cover composition | |
| Himilan 1605 | 50 |
| Himilan 1706 | 50 |
| Titanium oxide | 3 |
| Dispersant | 1 |
| Bluing agent | 0.01 |

The balls were measured for various parameters as well as an initial velocity upon launching, carry and total distance, with the results shown in Table 1.

TABLE 1

| Components | | E1 | E2 | E3 | CE1 | E4 | E5 | E6 | CE2 |
|---|---|---|---|---|---|---|---|---|---|
| Polybutadiene*1 | | 100.0 | 100.0 | 100.0 | 100.0 | 100.0 | 100.0 | 100.0 | 100.0 |
| Zinc oxide | | 10.0 | 10.0 | 10.0 | 10.0 | 10.0 | 10.0 | 10.0 | 10.0 |
| Barium sulfate*2 | | — | 26.9 | — | 54.0 | — | 48.4 | — | 97.1 |
| Zirconium silicate*3 | | 53.7 | 26.9 | — | — | 96.5 | 48.4 | — | — |
| Chromite*4 | | — | — | 53.7 | — | — | — | 96.5 | — |
| Zinc acrylate | | 21.0 | 21.0 | 21.0 | 21.0 | 12.0 | 12.0 | 12.0 | 12.0 |
| Dicumyl peroxide | | 1.2 | 1.2 | 1.2 | 1.2 | 1.2 | 1.2 | 1.2 | 1.2 |
| Filler mean particle size (μm) | | 140 | 75 | 195 | 11 | 140 | 75 | 195 | 11 |
| Center | Outer diameter (mm) | 32.1 | 32.2 | 32.2 | 32.2 | 27.8 | 27.8 | 27.8 | 27.8 |
| | Weight (g) | 24.2 | 24.3 | 24.1 | 24.2 | 17.9 | 17.9 | 17.8 | 17.9 |
| | Hardness*5 (mm) | 1.8 | 1.8 | 1.9 | 1.8 | 3.2 | 3.2 | 3.1 | 3.2 |
| | JIS C hardness*6 | 55 | 55 | 53 | 55 | 43 | 43 | 45 | 43 |
| | Specific gravity (g/cm$^3$) | 1.390 | 1.385 | 1.380 | 1.382 | 1.561 | 1.559 | 1.555 | 1.556 |
| Wound core | Outer diameter (mm) | 39.9 | 39.9 | 39.8 | 39.9 | 40.0 | 39.9 | 39.8 | 39.9 |
| | Weight (g) | 36.1 | 36.1 | 35.9 | 35.9 | 35.9 | 36.0 | 35.8 | 35.9 |
| | Hardness*7 (mm) | 3.2 | 3.1 | 3.2 | 3.2 | 3.2 | 3.2 | 3.1 | 3.2 |
| Ball | Outer diameter (mm) | 42.68 | 42.65 | 42.67 | 42.67 | 42.67 | 42.64 | 42.65 | 42.66 |
| | Weight (g) | 45.4 | 45.5 | 45.4 | 45.4 | 45.3 | 45.2 | 45.2 | 45.3 |
| | Hardness*7 (mm) | 3.0 | 3.0 | 3.1 | 3.0 | 3.0 | 3.0 | 2.9 | 3.0 |
| Performance*8 | Initial velocity (m/s) | 65.5 | 65.3 | 65.5 | 65.1 | 65.6 | 65.5 | 65.6 | 65.2 |
| | Carry (m) | 212.5 | 210.6 | 211.8 | 208.9 | 211.8 | 210.4 | 211.5 | 209.2 |
| | Total (m) | 225.3 | 222.8 | 224.5 | 220.7 | 224.3 | 223.1 | 223.8 | 219.9 |

*1BR01 commercially available from Nippon Synthetic Rubber K.K.
*2Barico #100 having a mean particle size of 11 μm commercially available from Hakusui Chemical K.K.
*3zirconium silicate having a mean particle size of 140 μm
*4chromite having a mean particle size of 195 μm
*5distortion under a load of 30 kg
*6hardness at the center as measured by a JIS C scale hardness meter
*7distortion under a load of 100 kg
*8results of a swing robot test of hitting the ball with a driver at a head speed of 45 m/s.

The Mohs scale of hardness of various weight adjusters is given below.

| | Mohs scale of hardness |
|---|---|
| Zirconium silicate | 7.5 |
| Barium sulfate | 3.5 |
| Chromite | 5.5 |
| Iron oxide | 5.5 |

Examples 7–9 and Comparative Example 3

Solid golf balls were prepared. A solid core was first prepared by kneading a core-forming rubber composition of the formulation shown in Table 2 in a roll mill and vulcanizing the composition in a mold at 155° C. for about 15 minutes.

A resin stock consisting of Hitrel 4047 was injection molded over the solid core to form an intermediate layer. A cover stock of the same composition as used in Examples 1 to 6 was injection molded over the solid core in a negative dimple pattern-bearing mold, obtaining a three-piece solid golf ball. It is noted that the ionomer cover stock and the intermediate layer-forming resin stock were adjusted in specific gravity and hardness by adding an appropriate amount of titanium dioxide, barium sulfate, magnesium stearate, etc.

The balls were measured for various parameters as well as an initial velocity upon launching, carry and total distance, with the results shown in Table 2.

TABLE 2

| Components | | E7 | E8 | E9 | CE3 |
|---|---|---|---|---|---|
| Polybutadiene*1 | | 100.0 | 100.0 | 100.0 | 100.0 |
| Zinc oxide | | 5.0 | 5.0 | 5.0 | 5.0 |
| Barium sulfate*2 | | — | 11.2 | — | 22.5 |
| Zirconium silicate*3 | | 22.4 | 11.2 | — | — |
| Chromite*4 | | — | — | 22.4 | — |
| Zinc acrylate | | 21.0 | 21.0 | 21.0 | 21.0 |
| Dicumyl peroxide | | 1.2 | 1.2 | 1.2 | 1.2 |
| Filler mean particle size (μm) | | 140 | 75 | 195 | 11 |
| Solid core | Outer diameter (mm) | 35.3 | 35.3 | 35.3 | 35.3 |
| | Weight (g) | 27.2 | 27.2 | 27.1 | 27.1 |
| | Hardness*7 (mm) | 1.8 | 1.8 | 1.7 | 1.8 |
| | JIS C hardness*6 | 62 | 62 | 63 | 62 |
| | Specific gravity (g/cm$^3$) | 1.187 | 1.186 | 1.184 | 1.186 |
| Intermediate layer-bearing core | Outer diameter (mm) | 38.8 | 38.8 | 38.8 | 38.8 |
| | Weight (g) | 35.5 | 35.5 | 35.5 | 35.5 |
| | Hardness*7 (mm) | 3.9 | 3.9 | 3.8 | 3.9 |
| Ball | Outer diameter (mm) | 42.70 | 42.70 | 42.71 | 42.69 |
| | Weight (g) | 45.3 | 45.3 | 45.2 | 45.3 |
| | Hardness*7 (mm) | 3.0 | 3.0 | 2.9 | 3.0 |
| Performance*6 | Initial velocity (m/s) | 65.8 | 65.7 | 65.8 | 65.5 |
| | Carry (m) | 213.1 | 211.3 | 212.4 | 209.4 |
| | Total (m) | 227.7 | 225.2 | 226.9 | 223.5 |

It is evident from Tables 1 and 2 that the ball is improved in initial velocity and increased in flight distance by blending zirconium silicate, a mixture of zirconium silicate and barium sulfate, and chromite all having a large mean particle size in a core-forming rubber composition.

Although some preferred embodiments have been described, many modifications and variations may be made thereto in the light of the above teachings. It is therefore to be understood that within the scope of the appended claims, the invention may be practiced otherwise than as specifically described.

I claim:

1. A golf ball comprising: a core and a cover, wherein the core is a solid core or a center of a wound core that is prepared by molding and vulcanizing a rubber composition comprising 100 parts by weight of base rubber and at least 10 parts by weight of a weight adjuster having a mean particle size of 30 to 1,000 μm and a specific gravity of at least 4.

2. The golf ball of claim 1 wherein said weight adjuster has a hardness of at least 3.5 on Mohs scale.

3. The golf ball of claim 1 wherein said rubber composition has a specific gravity in the range of 1.15 to 1.8.

4. The golf ball of claim 1 wherein said weight adjuster is at least one member selected from the group consisting of zirconium silicate, barium sulfate, chromite, and iron oxide.

5. The golf ball of claim 1 wherein said core is a solid core and said rubber composition comprises 10 to 25 parts of said weight of a particulate weight adjuster.

6. The golf ball of claim 1 wherein said core is a wound core and said rubber composition comprises 10 to 100 parts by weight of a particulate weight adjuster.

7. The golf ball of claim 1 wherein said core comprises a solid core and an overlying intermediate layer.

8. The golf ball of claim 1 wherein said core comprises a solid center and a thread rubber wound thereon.

9. The golf ball of claim 1 wherein said weight adjuster has a hardness of at least 5 on Mohs scale.

10. The golf ball of claim 1 wherein said core comprises a solid multipiece core having a diameter in the range of 34 to 41 mm.

11. The golf ball of claim 10 wherein said core has a weight in the range of 24 to 35 grams.

12. The golf ball of claim 10 wherein said core has a hardness at the center in the range of 50 to 80 measured by JIS-C.

13. The golf ball of claim 1 wherein said core is a wound core having a solid center with a diameter in the range of 26 to 35 mm.

14. The golf ball of claim 13 wherein the diameter of said wound core is in the range of 38 to 41 mm.

15. The golf ball of claim 14 wherein said wound core has a weight in the range of 35 to 38 grams.

16. The golf ball of claim 13 wherein said solid center has a hardness at its center in the range of 30 to 70 as measured by JIS-C.

17. The golf ball of claim 1 wherein said cover is a single layer having a hardness in the range of 43 to 65 on Shore D.

18. The golf ball of claim 1 wherein said cover is a multi-layer structure with an inner layer having a hardness in the range of 60 to 65 on Shore D and an outer layer having a hardness in the range of 43 to 53 on Shore D.

19. The golf ball of claim 1 wherein said cover is a single layer having a thickness in the range of 1 to 2.5 mm.

20. The golf ball of claim 1 wherein said cover is a multi-layer structure with an inner layer having a thickness in the range of 0.5 to 2 mm and an outer layer having a thickness in the range of 0.5 to 2 mm.

* * * * *